United States Patent [19]

Wonders

[11] Patent Number: 5,064,392

[45] Date of Patent: Nov. 12, 1991

[54] SELF-PROPELLED FLOATABLE FIRE NOZZLE

[76] Inventor: Scott Wonders, 3119 - 59th St., Port Arthur, Tex. 77640

[21] Appl. No.: 586,959

[22] Filed: Sep. 24, 1990

[51] Int. Cl.[5] ..... B63H 11/00

[52] U.S. Cl. ..... 440/39; 169/62

[58] Field of Search ..... 440/38, 39, 47; 169/62, 169/13, 30, 46, 5, 16

[56] References Cited

U.S. PATENT DOCUMENTS 3,139,060 6/1964 Dane ..... 440/47
3,288,100 11/1966 Cox et al. ..... 440/47
3,339,516 9/1967 Lenci ..... 440/39
3,624,737 11/1971 Keller ..... 440/47
4,850,908 7/1989 Narase et al. ..... 440/39

*Primary Examiner*—Sherman Basinger
*Assistant Examiner*—Stephen P. Avila
*Attorney, Agent, or Firm*—Kenneth D. Baugh

[57] ABSTRACT

A self propelled floatable nozzle 10 is provided including a support housing 14. A water piping system 16 and an air piping system 18 are supported in the housing 14. The water piping system 16 and air piping system 18 cooperate upon opening and closing of gate valves 32 to provide water for fighting a fire as well as propulsion to move the nozzle 10 in a desired direction as water and air are displaced through orifices 46 and bypass valve 48.

9 Claims, 4 Drawing Sheets

SELF-PROPELLED FLOATABLE FIRE NOZZLE

TECHNICAL FIELD

This invention relates to a fire fighting apparatus and more particularly to a floatable self propelled apparatus for fighting dock fires. Dock fires have traditionally created very frustrating conditions for fire fighters. This is because swimming while pushing the traditional floating nozzle used to extinguish dock fires causes rapid exhaustion among diver/fire fighters. Exhaustion in a diver/fire fighter creates an unusually unsafe condition. The only way to avoid this condition has been to have several relief diver/fire fighters. This of course is very costly in manpower hours. The other alternative is to fight the fire from water level. This to is also very costly, in that, most if not all of the dock will likely be destroyed by the fire. This is because the underside of a dock is usually in accessible due to items stored on top of the dock, such as, for example, building materials.

Additionally most older docks are constructed of heavy timber. This hampers the fire fighters efforts to control a fire because it is impractical to remove the number of timbers required to gain full access to the underside of the deck. Another problem for land based fire fighters fighting dock fires is that they battle the fire in zero visibility. This causes the need to place holes in the dock through which the fire is to be fought. These holes however can become dangerous man-traps for the disoriented fire fighters who could fall through these openings and become a casualty.

Because of the various problems associated with the present methods of fighting dock fires it is desirable to provide a self-propelled floating nozzle which would allow a diver/fire fighter to work an unlimited amount of time without fear of exhaustion and the other dangers associated with fighting a dock fire from ground level.

BACKGROUND ART

A number of attempts have been made to provide fire fighting systems to fight various fires in and around water in addition to the traditional floating nozzle. However most of these systems have been devices which are secured to and operated from a vessel, such as, a boat or ship. One system is illustrated in U.S. Pat. No. 3,339,516 which discloses a jet propelled fire fighting boat. Although this system works because it is a boat it is impractical for use in fighting dock fires because of the desirability of fighting the fire from under the dock.

DISCLOSURE OF THE INVENTION

A self propelled floatable fire nozzle in accordance with the principles of this invention includes a support housing and a means for directing water flow through the support housing. Water inlet and outlet ports are coupled to the water flow directing means. A means is provided for directing air from an air supply through the support housing in a predetermined direction. The nozzle also includes a means for causing the water and air to interact to create propulsion. A means for controlling the flow of water through the water flow directing means is provided. As a result when the control means is in one position water can be directed through the water flow directing means to the outlet port and when the control means is in another position water can be directed through the water flow directing means to the outlet port and the interacting means to cause the nozzle to be propelled.

BRIEF DESCRIPTION OF THE DRAWING

The details of the invention will be described in connection with the accompanying drawing in which.

DESCRIPTION OF THE PREFERRED EMBODIMENT

Figure 1:
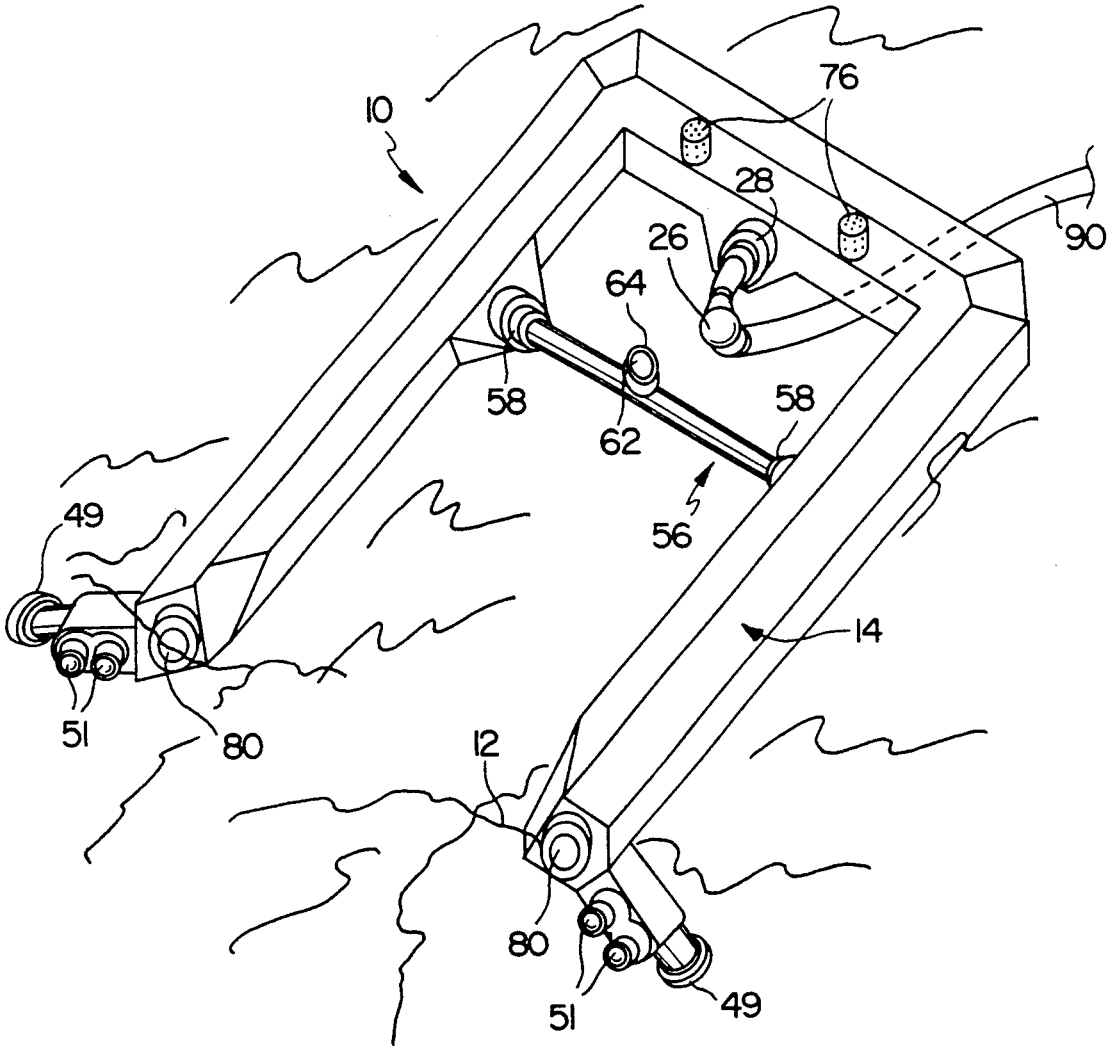
FIG. 1 is a prospective view illustrating the Self-Propelled Floatable Nozzle in accordance with the principles of this invention.
Figure 2:
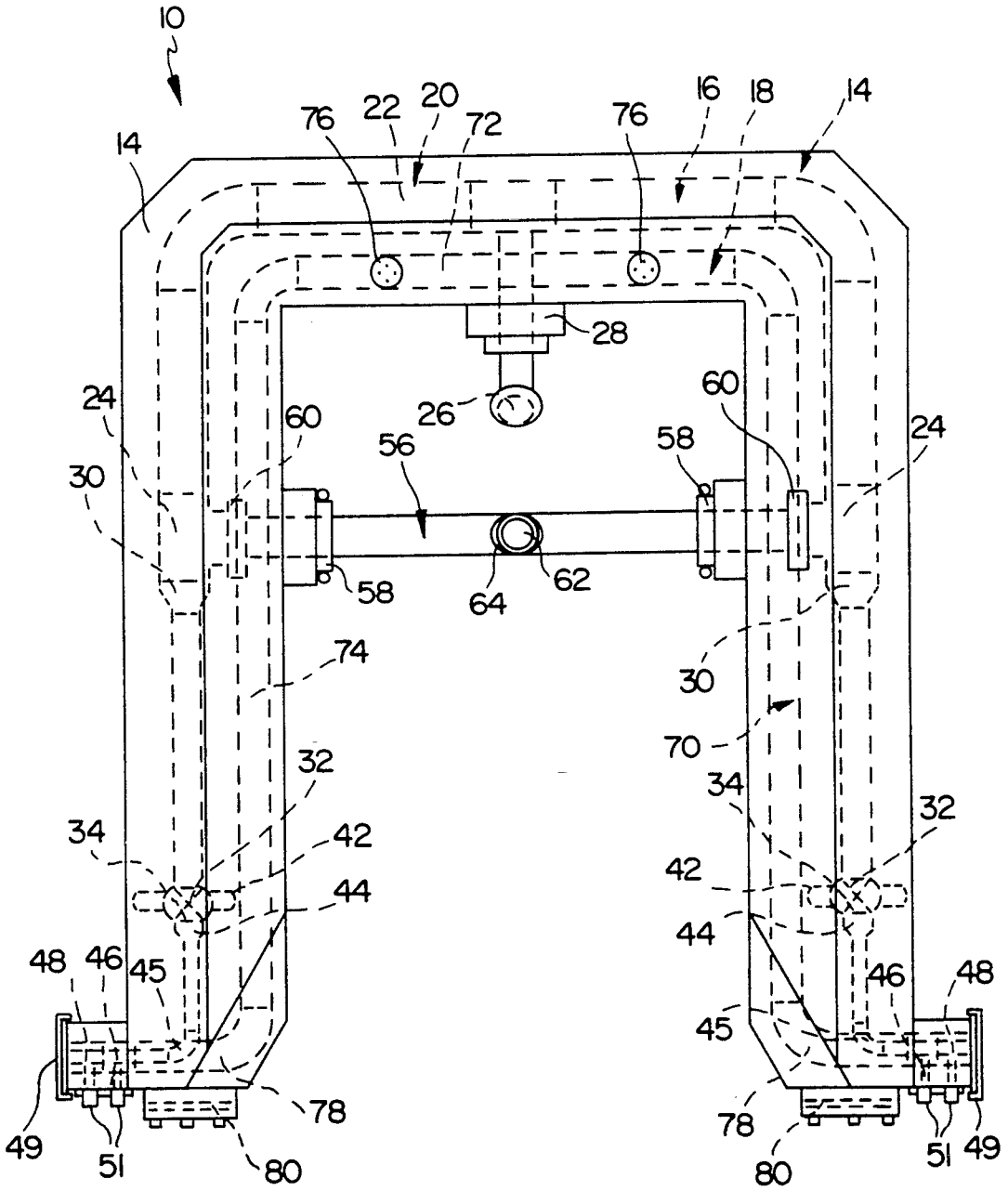
FIG. 2 is an exposed view of the Self-Propelled Floatable Nozzle in accordance with the principles of this invention.

Referring to FIGS. 1 and 2 there is shown a Self-Propelled Floatable Nozzle, generally designated, by the numeral, 10 which is propellable through water 12. The nozzle 10 is provided with a hollow U-shaped support housing, generally designated, by the numeral, 14. The support housing 14, may be, for example made of a fiberglass material capable of floating in water. The nozzle 10 is provided with a water piping system, generally designated, by the numeral, 16 and an air piping system, generally designated, by the numeral, 18 (FIG. 2). The water piping system 16 and air piping system 18 cooperate to provide water for fighting a fire as well as propulsion to move the nozzle 10 in the desired direction.

Figure 3:
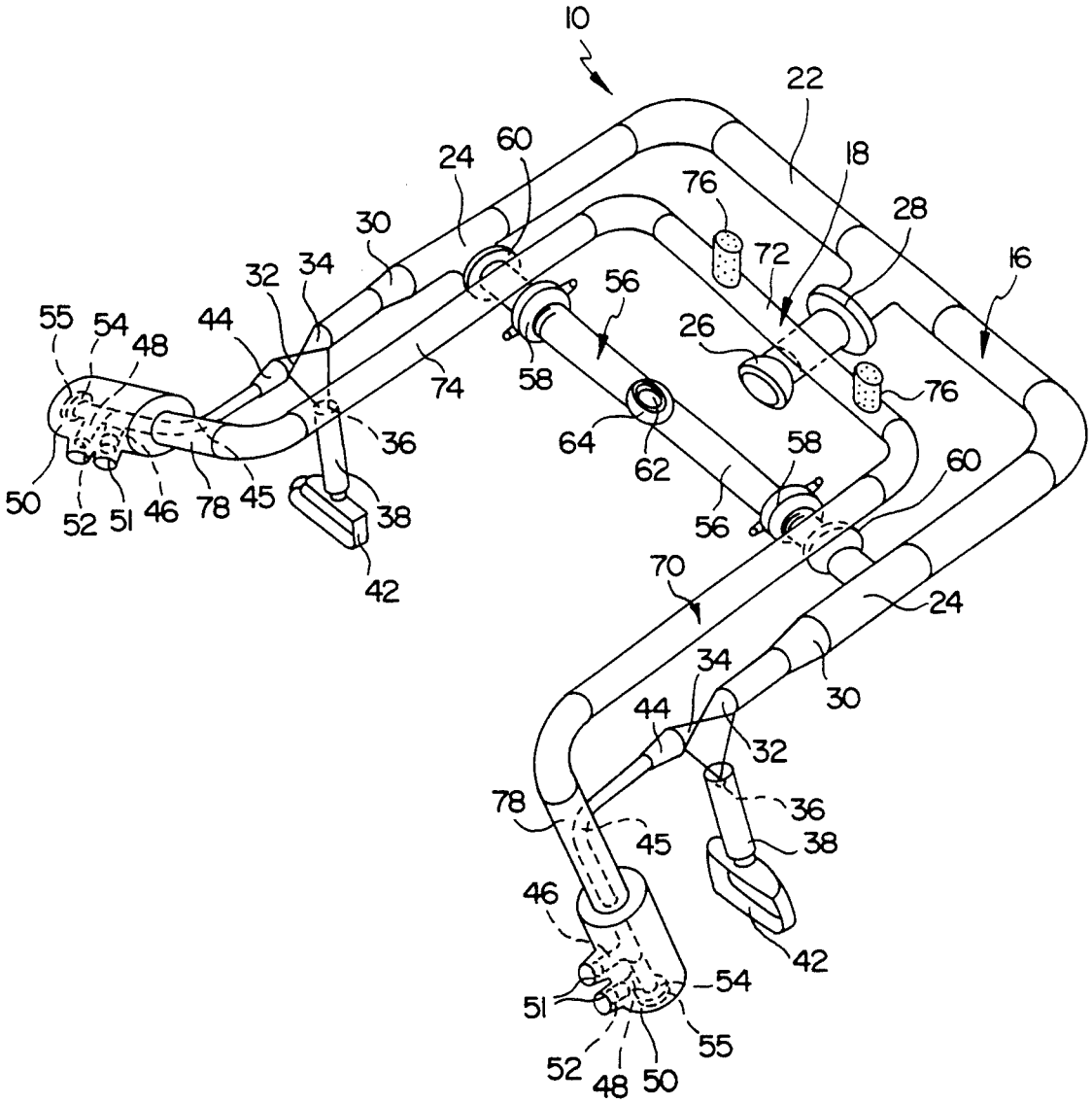
FIG. 3 is a prospective view illustrating the internal operating systems of the Self-Propelled Floatable Nozzle in accordance with the principles of the invention.

As illustrated in FIGS. 2 and 3 the water piping system 16 is provided with a U-shaped water piping member, generally designated, by the numeral, 20. The U-shaped water piping member 20 includes an intermediate elongated member 22 and elongated end members 24 coupled to the intermediate members. The intermediate elongated member 22 is provided with a water inlet nozzle 26 which is coupled thereto by an adapter 28. The water inlet nozzle 26 is coupled to the intermediate elongated member 22 so that it is turned downward at a 30 degree angle. This facilitates easy access to the nozzle 26 and prevents the nozzle 26 from interfering with the fire fighter. Each elongated end member 24 of the U-shaped water piping member 20 is provided with a reducing member 30 which is coupled to a standard gate valve, generally designated, by the numeral, 32. The reducing members 30 are provided to reduce the volume of water coming into the gate valves 32 to a predetermined level. The gate valves 32 are provided with a valve housing 34 and a valve stem or handle 36. The stem and housing interact with each other in a well known manner to allow the gate valve to be opened or closed. The stem 36 is provided with an extension or arm 38 having a hand grip 42 coupled to one end thereof.

Figure 4:
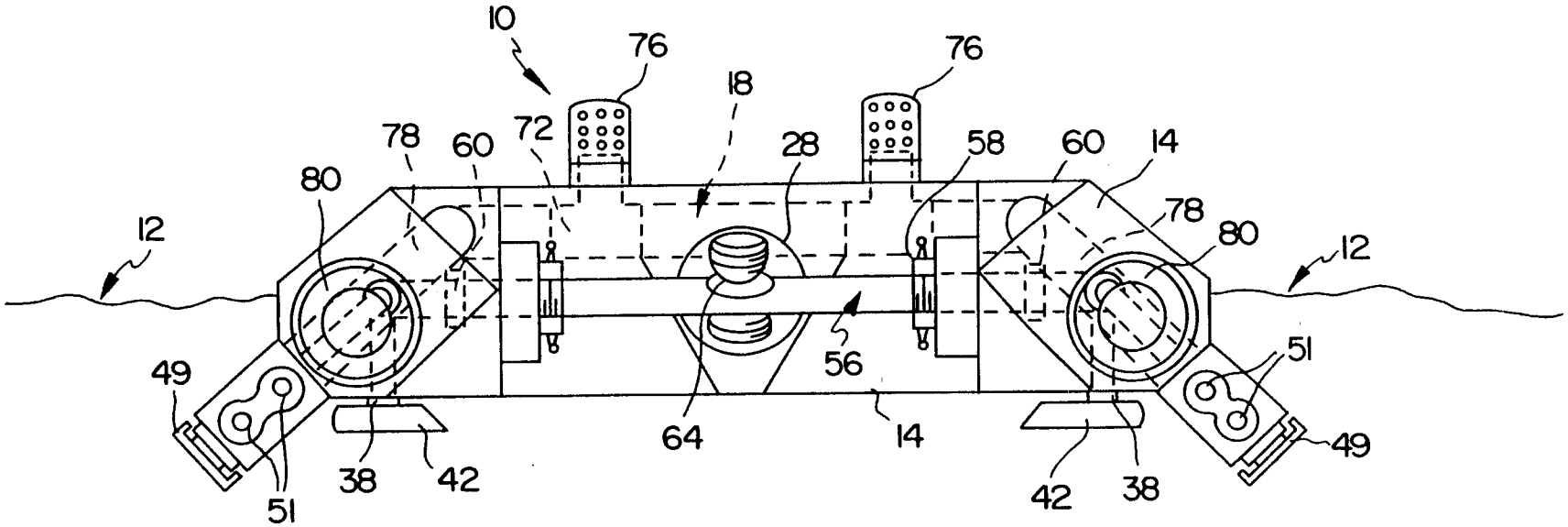
FIG. 4 is an end view of the Self-Propelled Floatable Nozzle in accordance with the principles of this invention.

A second reducing member 44 having an L-shaped pipe portion 45 is coupled from each gate valve 32 to an orfice and an adjustable needle valve, generally designated, by the numerals, 46 and 48 respectfully. The orfice 46 and the needle valve 48 are supported in a housing 49 which is coupled to the support housing 14. Each housing 49 is also provided with access openings 50. The orfice 46 and bypass valve 48 are provided with an access opening 51 so that water can escape the valve and orfice and so that the valve can be preset for a predetermined volume of water at point 52. Each of the bypass valves 48 are additionally provided with a valve adjustment 54 (FIGS. 2–4). A cap 55 is mounted in the bypass valve housing 49 and provides access to the bypass adjustment 54 in a well known manner so that the valve can be further opened and closed if desired to increase the volume of water flowing therein.

A horizontally extending pipe member, generally designated by the numeral, 56 is coupled between the elongated end members 24 in parallel spaced relationship with the intermediate elongated member 22. The pipe member 56 which has threads formed at each end thereof is threadedly coupled at each end to a coupler 58 mounted on the support housing 14 and to the elongated end members by coupling 60. The pipe member 56 is provided with a threaded outlet opening 62 formed therein which receives a standard fire nozzle 64 (FIG. 4).

The air piping system 18 of the floatable nozzle 10 is provided with a U-shaped air piping member, generally designated by the numeral, 70. The air piping member 70 is aligned adjacent to and spaced from the water piping member 20 in the housing 14. The air piping member 70 includes an intermediate elongated member 72 and elongated end members 74 perpendicularly coupled to the intermediate elongated member.

The intermediate elongated member 72 is provided with a pair of spaced aligned air intake orfices 76. The air intake orfices 76 facilitates the injection of air into the air piping member 70.

Each elongated end member 74 of the air piping member 70 is coupled at an end 78 thereof into the valve housing 49 so that it encases pipe member 45 which is coupled to the orfice 46 and bypass valve 48. This permitts air and water to interact in the valve housing 49 thus causing propulsion when the water is forced out of the opening 50 by the air.

A pressure release valve 80 is coupled to the support housing 14 adjacent the orfice 46 and bypass valve 48. These pressure release valves 80 are provided to maintain the pressure in the housing at a predetermined internal pressure, such as, for example, fifteen psi to insure optimum operation of the nozzle 10.

When the floatable nozzle 10 is to be used to put out a dock fire, a fire hose 90 from a water pump (not shown) is coupled to the water inlet nozzle 26. With the gate valves 32 maintained in a closed position water will flow from the inlet nozzle 26 to the outlet opening 62 and fire nozzle 64 as indicated by arrows 92 thus giving the fire fighter the needed water to fight the fire. As long as the gate valves 32 are closed all water from the inlet nozzle 26 is directed to the nozzle 64 and no water reaches the needle valves 46 and 48. As a result the nozzle 10 will simply float on the water as it is used by the fire fighter. When it is desired to propel the nozzle 10 the water flowing from the water inlet nozzle 26 is used to create mobility. This is accomplished by opening the gate valves 32 so that water can also flow from the inlet nozzle 26 to the orifice 46 and bypass valve 48 as indicated by arrows 94 and 95. The flow of water to the orfice 46 and bypass valve 48 causes air to be pulled into the orfices 76 through the air piping member 70 and into the orfice 46 and bypass valve 48 as indicated by the arrows 96. This forces the water that is coming out of the orfice 46 and the bypass valve 48 to travel in only one direction. The movement of the water through the orfice 46 and the bypass valve 48 with the pressurized air flowing from the orfices 76 into the valve housing 49 creates a pulling effect on the air chamber piping thereby causing a jet propulsion effect through outlets 50 and the desired forward movement of the nozzle 10. Adjustment of only one of the gate valves 32 at a time will permit the nozzle 10 to be moved to the right and/or to the left as desired by the user. The valve adjustment 54 allows the user to adjust bypass valves 48 and thus the volume of water flowing therethrough to provide for increased or decreased propulsion.

The invention has been shown and described in what is considered to be the most practical and preferred embodiment. However, it should be recognized that changes may be made by those skilled in the art without departing from the spirit and scope of the invention.

What is claimed:

1. A self propelled floatable fire nozzle including:

a support housing;

a pair of spaced aligned pressure relief valves to maintain the internal pressure of the support housing at a predetermined level;

means for directing water flow through the housing in a predetermined direction, the water flow directing means including an intermediate member, a first elongated member perpendicularly coupled to one end of the intermediate member, a second elongated member perpendicularly coupled to the other end of the intermediate member, and a horizontally extending member coupled between the first and second elongated members in parallel spaced relationship with the intermediate member;

a water inlet port coupled to the intermediate member;

a water outlet port coupled to the horizontally extending member;

means for supplying water to the water inlet port;

means for directing air flow through the housing in a predetermined direction;

means for supplying air to the air flow directing means;

means for interacting water from the water flow directing means with the air from the air flow directing means to create propulsion; and means for controlling the flow of water through the water flow directing means so that water can be directed to the outlet nozzle when in one position and so that water can be directed to the outlet nozzle and the interacting means when in another position to thereby cause propulsion.

2. A self propelled floatable fire nozzle as defined in claim 1 wherein the air flow directing means includes:

an intermediate member;

a first elongated member perpendicularly coupled to one end of the intermediate member; and a second elongated member perpendicularly coupled to the other end of the intermediate member.

3. A self propelled floatable fire nozzle as defined in claim 2 wherein the supplying means includes a pair of spaced aligned air intake orfices coupled to the intermediate member of the air flow directing means.

4. A self propelled floatable fire nozzle as defined in claim 3 wherein the interacting means includes:

a first housing, having discharge openings formed therein, coupled to the first elongated member of the air flow directing means;

a first bypass valve supported in the first housing and aligned to discharge through the discharge openings in the first 10 housing;

a second housing having discharge openings formed therein, coupled to the second elongated member of the air flow directing means; and a second pair of bypass valve supported in the second housing and aligned to discharge through the discharge opening in the second housing.

5. A self propelled floatable fire nozzle as defined in claim 4 wherein the first valve includes a means mounted in the first housing for adjusting the volume of water flowing through the valve.

6. A self propelled floatable fire nozzle as defined in claim 5 wherein the second bypass valve includes a means mounted in the second housing for adjusting the volume of water flowing through the valve.

7. A self propelled floatable fire nozzle as defined in claim 6 wherein the water flow control means includes:

a first gate valve;

a first member for coupling the first gate valve to the first elongated member of the water flow directing means;

a second member having portions thereof aligned in the first elongated member of the air flow directing means, for coupling the first gate valve to the first bypass valve;

a second gate valve;

a third member for coupling the second gate valve to the second elongated member of the water flow directing means; and a fourth member, having portions thereof aligned in the second elongated member of the air flow directing means, for coupling the second gate valve to the second bypass valve.

8. A self propelled floatable fire nozzle as defined in claim 7 wherein the first coupling member is a reducing member for reducing the volume of water flowing from the water flow directing means to the first gate valve and wherein the second coupling member is a reducing member for reducing the volume of water flowing from the first gate valve to the bypass valve.

9. A self propelled floatable fire nozzle as defined in claim 8 wherein the third coupling member is a reducing member for reducing the volume of water flowing from the water flow directing means to the second gate valve and wherein the second coupling member is a reducing member for reducing the volume of water flowing from the second gate valve to the bypass valve.

* * * * *